US008483915B2

(12) United States Patent
Lanzl et al.

(10) Patent No.: US 8,483,915 B2
(45) Date of Patent: Jul. 9, 2013

(54) CONSTRUCTION APPARATUS FOR FOUNDATION CONSTRUCTION

(75) Inventors: Martin Lanzl, Ingolstadt (DE); Manuel Peter Ostermeier, Pobenhausen (DE); Markus Mayr, Ehekirchen (DE); Stefan Schnitzler, Aresing (DE)

(73) Assignee: Bauer Maschinen GmbH (DE)

( * ) Notice: Subject to any disclaimer, the term of this patent is extended or adjusted under 35 U.S.C. 154(b) by 412 days.

(21) Appl. No.: 12/797,199

(22) Filed: Jun. 9, 2010

(65) Prior Publication Data

US 2010/0319222 A1 Dec. 23, 2010

(30) Foreign Application Priority Data

Jun. 17, 2009 (EP) ..... 09007945

(51) Int. Cl.
*G06F 19/00* (2011.01)

(52) U.S. Cl.
USPC ..... 701/50

(58) Field of Classification Search
USPC ..... 37/348, 466, 468; 172/2–11; 700/91, 700/86, 52, 54, 60, 69, 169, 175, 180, 186, 700/192; 701/50–53; 414/735, 687; 212/278; 219/124.4
See application file for complete search history.

(56) References Cited

U.S. PATENT DOCUMENTS

| | | | | |
|---|---|---|---|---|
| 3,665,148 | A * | 5/1972 | Yasenchak et al. | 219/124.4 |
| 4,688,983 | A * | 8/1987 | Lindbom | 414/735 |
| 4,746,264 | A * | 5/1988 | Kishi et al. | 414/687 |
| 5,732,835 | A * | 3/1998 | Morita et al. | 212/278 |
| 6,064,918 | A * | 5/2000 | Ohtsukasa et al. | 700/91 |

FOREIGN PATENT DOCUMENTS

| | | | |
|---|---|---|---|
| CN | 1330204 | A | 1/2002 |
| DE | 200 11 371 | U1 | 9/2000 |
| EP | 0 894 901 | A | 2/1999 |
| EP | 1 717 375 | A1 | 11/2006 |
| JP | H11-107326 | A | 4/1999 |

OTHER PUBLICATIONS

The Extended European Search Report dated Aug. 5, 2009; Patent No. EP 09 00 7945.
First Office Action issued by the State Intellectual Property Office, P.R. China on Nov. 23, 2011, which corresponds to Chinese Patent Application No. 201010211677.1 and is related to U.S. Appl. No. 12/797,199 with English translation.

* cited by examiner

*Primary Examiner* — Robert Pezzuto
(74) *Attorney, Agent, or Firm* — Studebaker & Brackett PC

(57) ABSTRACT

A construction apparatus for foundation construction includes a chassis, a mast for guidance of at least one ground working apparatus and a support mechanism for the mast, wherein the mast is arranged in an adjustable manner on the chassis. The support mechanism has at least one support arm, which is pivotably hinged about a pivot axis on the chassis. A rotary encoder is provided for detecting the pivot angle of the support arm relative to the chassis as a degree of an adjustment position of the mast.

13 Claims, 4 Drawing Sheets

CONSTRUCTION APPARATUS FOR FOUNDATION CONSTRUCTION

Figure 1:
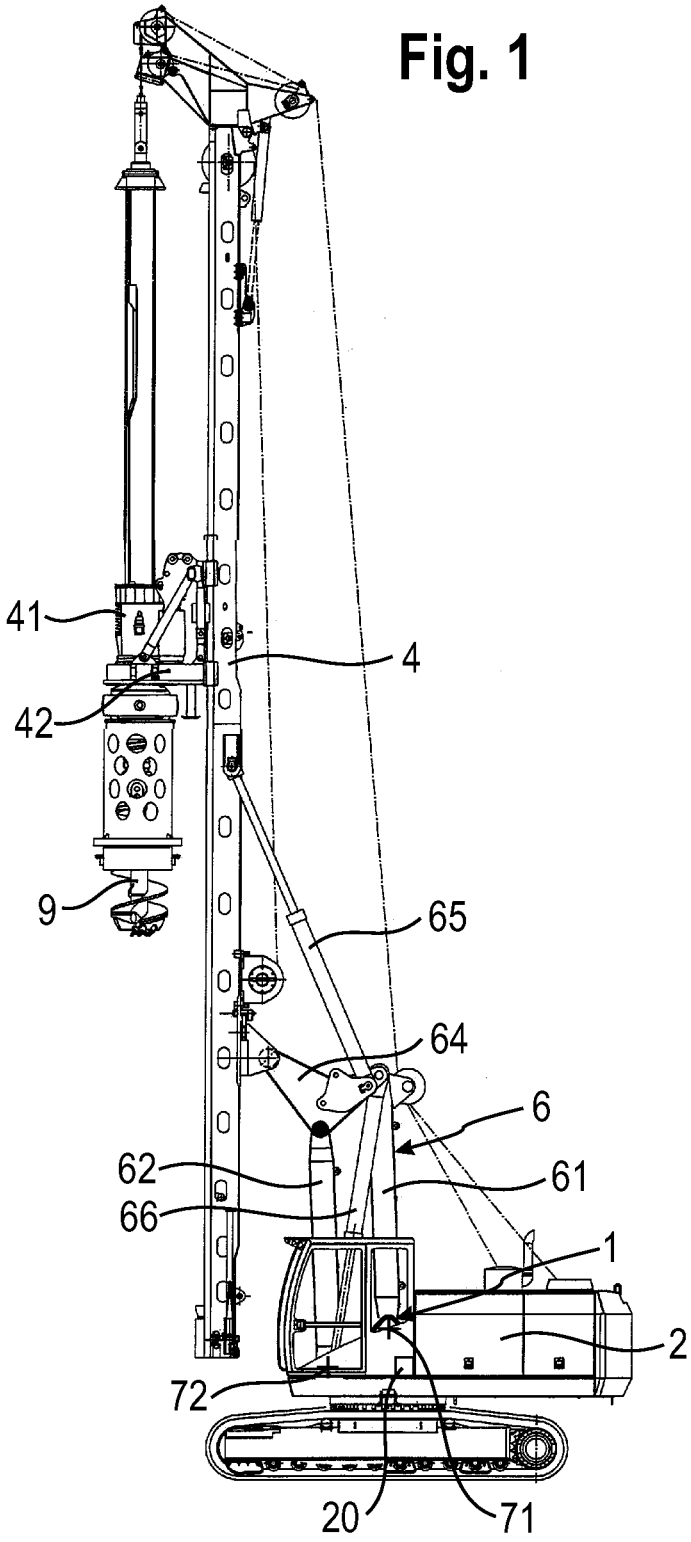

The invention relates to a construction apparatus for foundation construction in accordance with the preamble of claim 1. A construction apparatus of such type is designed with a chassis, a mast for guidance of at least one ground working apparatus and a support mechanism for the mast, by means of which the mast is arranged in an adjustable manner on the chassis, whereby the support mechanism has at least one support arm, which is pivotably hinged about a pivot axis on the chassis.

A construction apparatus having an adjustable support mechanism with parallelogram kinematics is known for instance from EP 1 717 375 A1. The support mechanism of EP 1 717 375 A1 can be used to raise the mast from a horizontal transport position into a vertical operating position.

In the case of construction apparatuses with a support mechanism for the mast the adjustment of the support mechanism can be accompanied by a considerable shift of the center of gravity, since the mast actuated by the support mechanism and the ground working apparatus arranged on the mast can constitute inter alia the largest weights on the construction apparatus. Therefore, depending on the design of the construction apparatus an unintended excessive actuation of the support mechanism could, in the extreme case, even lead to a toppling of the construction apparatus.

In order to avoid such an unintended adjustment of the support mechanism and therefore an impairment of tilt stability it is known, after erection of the mast, to provide a support clamp on the actuation cylinder of the support mechanism, which limits the actuation path of the support mechanism and thereby prevents an unintended movement into a critical operating range. However, this support clamp has to be attached manually after erection of the mast and must be removed manually again for the transport of the construction apparatus in order not to obstruct correct placement of the support mechanism into the transport position. Consequently, it cannot be ensured in each case that the support clamp is attached properly during operation.

The object of the invention is to provide a construction apparatus for foundation construction, which possesses a particularly high operational reliability.

The object is solved in accordance with the invention by a construction apparatus having the features of claim 1. Preferred embodiments are stated in the dependent claims.

The construction apparatus according to the invention is characterized in that a rotary encoder is provided for detecting the pivot angle of the support arm relative to the chassis as a degree of an adjustment position of the mast.

A first fundamental idea of the invention can be seen in the fact that the setting of the support mechanism and therefore the adjustment position of the mast is detected by sensors. Based on the data obtained hereby it is possible for example to emit an alarm if a setting is present that is critical with regard to the tilt stability or it is also possible to actively ensure by way of a control that the adjustment position of the mast stays in a range that is safe with regard to the current operating mode, i.e. depending on whether the apparatus is being transported or in operation. Due to the fact that such a sensor in accordance with the invention only detects the setting of the support mechanism and therefore does not mechanically limit the operating range of the support mechanism as opposed to the afore-mentioned support clamp, such a sensor can basically remain on the support mechanism in every operating position. In contrast to the afore-mentioned support clamp the sensor does not have to be removed especially for transport purposes. Consequently, in accordance with the invention, the risk of the safeguarding measure against undesirable shifts of the center of gravity being accidentally inactive can be minimized. As a result, an especially high operational reliability is given in accordance with the invention.

Another fundamental idea of the invention can be seen in the fact that the pivot angle of the support arm about the pivot axis is detected as a degree of the adjustment position of the support mechanism and therefore as a degree of the adjustment position of the mast, i.e. that a rotary encoder is provided as a sensor for the adjustment position of the mast, which is arranged between the support arm and the chassis. The invention appreciates that on the one hand the pivot angle of the support arm relative to the chassis provides especially significant information about the adjustment position of the mast and therefore the tilt stability and that on the other hand this pivot angle can be detected by sensors in a particularly easy and reliable manner even under rough operating conditions. For a pivot angle measurement can be carried out with compact sensors and in an area well-protected against the drilling tool. By making use in accordance with the invention of a rotary encoder on the support arm, operational reliability can be increased further, since particularly significant values on the adjustment position can be obtained in an especially reliable way.

The construction apparatus concerned can be a drilling apparatus for example so that the ground working apparatus is preferably a drill bit. The construction apparatus can, however, also be a vibrating apparatus for example, in which case the ground working apparatus is then a vibrator, or the construction apparatus can be a trench wall cutter, in which case the ground working apparatus can be a cutting means with cutting wheels. For best suitability, the mast serves to guide the ground working apparatus in a displaceable manner in the vertical direction. The chassis according to the invention can be a crawler-track running gear in particular. For best suitability, the chassis also holds the drive units and/or operating elements for operation of the construction apparatus and/or also a counterweight for the mast.

In accordance with the invention the mast is coupled via the adjustable support mechanism with the chassis. In particular, provision can be made for the support mechanism to carry at least the main load of the mast or even the entire weight of the mast. By preference, the support mechanism can have at least one linkage, in particular a parallelogram linkage, in which the support arm preferably constitutes a member of this linkage.

The pivot axis, about which the support arm is pivotably hinged on the chassis, preferably runs horizontally. Within the meaning of the invention the pivot axis can be understood in particular as an axis in the mathematical sense, i.e. as a fictitious line. Along the pivot axis according to the invention at least one axial bolt is preferably provided, through which the support arm is supported on the chassis.

For detection of the pivot angle of the support arm the rotary encoder is suitably arranged between the support arm and the chassis, i.e. a first encoder part is arranged in a rotationally fixed manner on the support arm and a second encoder part is arranged in a rotationally fixed manner on the chassis. The rotary encoder according to the invention can also be referred to as angular position gauge.

It is particularly preferred that a positioning drive for adjusting the mast relative to the chassis is provided. In particular, the positioning drive can serve for pivoting the support arm relative to the chassis. The positioning drive can, in particular, be a linear drive, for example a hydraulic cylinder which is preferably hinged on the one hand on the chassis and on the other hand on the support arm. Provision can also be made for further positioning drives for adjusting the mast relative to the chassis.

Provision can be made that values obtained from the rotary encoder are displayed and/or that an alarm signal is generated if a control based on the values obtained by means of the rotary encoder ascertains a critical adjustment position of the mast. For example a warning signal can be emitted if an angular range has been reached that is critical for the respective operating condition.

It is especially preferred that a control unit for controlling the positioning drive is provided, which is in signal connection with the rotary encoder. Such a control unit renders it possible that in the event of a critical adjustment position counter-measures are introduced automatically against the critical position. Hence, the control unit suitably controls the positioning drive in dependence on the pivot angle values detected by the rotary encoder. More particularly, provision can be made for the control unit to include the current operating condition in the angle-dependent control of the positioning drive, in particular by taking into consideration whether the mast is located in the vertical operating position or in the horizontal transport position. If further positioning drives are provided, the control unit can also be adapted for a pivot-angle-dependent control of at least one of the further positioning drives.

A preferred embodiment of the invention resides in the fact that the control unit is adapted such that in the case of certain pivot angles of the support arm relative to the chassis it counteracts an excessive adjustment of the mast by the positioning drive. For example provision can be made that certain control commands which would render the adjustment position of the mast even more critical are no longer transmitted from the control unit to the positioning drive if a certain pivot angle range has been reached. Alternatively or additionally it can be provided that when a certain pivot angle range is present the control unit actuates by itself the positioning drive such that the mast is repositioned into a safe range.

It is especially advantageous that with the positioning drive, which can be controlled by the control unit depending on the pivot angle in particular, the support arm and/or the mast can be pivoted about the pivot axis. According to this embodiment the control unit can therefore act on such a positioning drive, with which the support arm and/or the mast can be pivoted about the pivot axis. As a result, the control processes can be facilitated because by way of the control unit a direct influence can be exerted on the value that is also the input variable for the control unit. If the control unit controls several positioning drives depending on the pivot angle, at least one of the further positioning drives can also serve for carrying out a different movement process.

A foundation construction apparatus that is particularly simple from a constructional viewpoint and at the same time reliable is given in that on its one side the support arm is pivotably hinged about the pivot axis on the chassis and on its other opposite lying side the support arm is coupled with the mast. For particularly complex mast movements further coupling parts and/or positioning drives can also be arranged between the support arm and the mast.

Operational reliability can be increased further in that in order to form a parallelogram kinematic mechanism the support mechanism has a further support arm which runs parallel to the first support arm. On their respective sides facing away from the chassis both support arms can then be connected through a coupling element, on which the mast is in turn arranged, in particular hinged.

If provision is made for a parallelogram kinematic mechanism, it is especially preferred that the first support arm, whose pivot angle is detected by the rotary encoder, is hinged above the further support arm on the chassis. Additionally or alternatively provision can be made for the further support arm to be arranged between the first support arm, whose angle is detected by the rotary encoder, and the mast. According to these embodiments the rotary encoder is provided on that support arm, which is particularly well-protected during constructional operation, so that the operational reliability is improved further.

For example with regard to the length of lines it is of advantage that the rotary encoder, especially its encoder housing, is arranged on the chassis. In such case use can be made, in particular, of stationary supply lines, which proves to be advantageous with regard to reliability.

Another preferred embodiment of the invention resides in the fact that the rotary encoder is arranged in the extension of the pivot axis. This enables a direct detection of the angular value of the support arm, as a result of which the operational reliability is enhanced further.

For best suitability, the rotary encoder has an encoder housing and an encoder shaft. The encoder shaft can, in particular, be arranged coaxially to the pivot axis, allowing for an especially simple construction.

Furthermore, it is advantageous for the encoder housing to be coupled in a rotationally fixed manner with the chassis and for the encoder shaft to be coupled in a rotationally fixed manner with the support arm. As a result, an especially compact encoder arrangement can be realized.

Another advantageous embodiment of the invention resides in the fact that for a rotationally fixed connection with an actuation element the encoder shaft of the rotary encoder has a flattening on its outer surface. By way of such a flattening, which preferably runs longitudinally of the encoder shaft, it can be ensured that an actuation element for the rotary encoder can only be attached in a defined angular position on the encoder shaft. The encoder shaft can also have e.g. at least one transversely running hole, with which a bolt connection with the actuation element can be established.

Moreover, it is advantageous if a cover is provided for the rotary encoder, in which the rotary encoder, especially its encoder housing, is accommodated in a rotationally fixed manner. For the rotationally fixed mounting of the rotary encoder on the cover at least one screw can be provided for example. Additionally or alternatively, on the cover and on the rotary encoder corresponding recesses and protrusions can be provided that bring about a form-locking connection. By means of the cover the encoder housing is suitably secured in a rotationally fixed manner on the chassis. In particular, the cover can have a cup-shaped design, in which case a sector-shaped recess can be provided in the cup-shape for the passage of supply lines of the rotary encoder.

A further embodiment of the invention resides in the fact that in the cover holes for a bolt connection, in particular with the chassis or the support arm, are formed. The bolts of this bolt connection can be screw bolts in particular. Advantageously, the holes have an asymmetrical hole pattern. In this way it can be ensured that the cover and therefore also the rotary encoder accommodated in a rotationally fixed manner in the former can only be attached in a defined angular position.

Another preferred embodiment of the invention resides in the fact that as actuation element for the rotary encoder an actuation bar is provided. Such a rotary bar is suitably connected, on the one hand, to the rotary encoder, more particularly to its encoder shaft. On the other hand, the actuation bar is preferably connected to the support arm.

For an especially compact arrangement the actuation bar suitably has a stepped profile, in particular a multi-stepped profile. As a result, a bar contour can be realized that is especially well-adapted to the contour of the neighboring elements, i.e. in particular the contour of the rotary encoder with cover. In this way, any protruding elements that might be critical with regard to the operational reliability are avoided. The multi-stepped profile can, in particular, have stepped edges running transversely to the bar.

By preference, the rotary encoder according to the invention is an absolute encoder. Due to the fact that in an absolute encoder the absolute position is known on account of the sensor construction, a reference run which would perhaps also have to lead through tilt-critical angular ranges is not necessary.

The invention also relates to a method for operating a construction apparatus according to the invention, in which, in the case of certain pivot angles of the support arm relative to the chassis, an excessive adjustment of the mast by at least one positioning drive is counteracted by means of a control unit. In particular, it may be provided that angle-increasing control inputs for the positioning drive are suppressed by means of the control unit, if the pivot angle detected by the rotary encoder reaches or exceeds a limit value.

Figure 2:
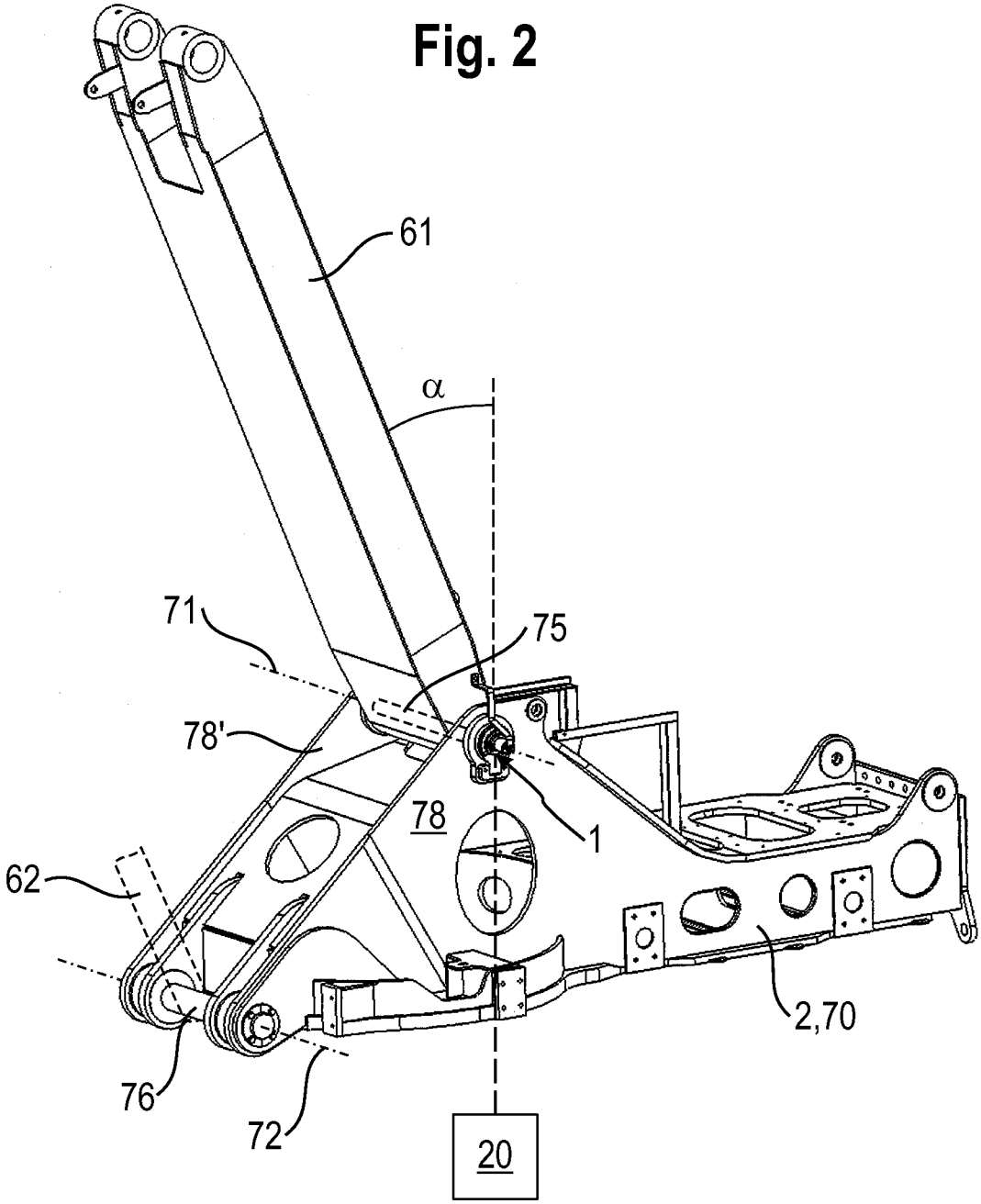
Figure 3:
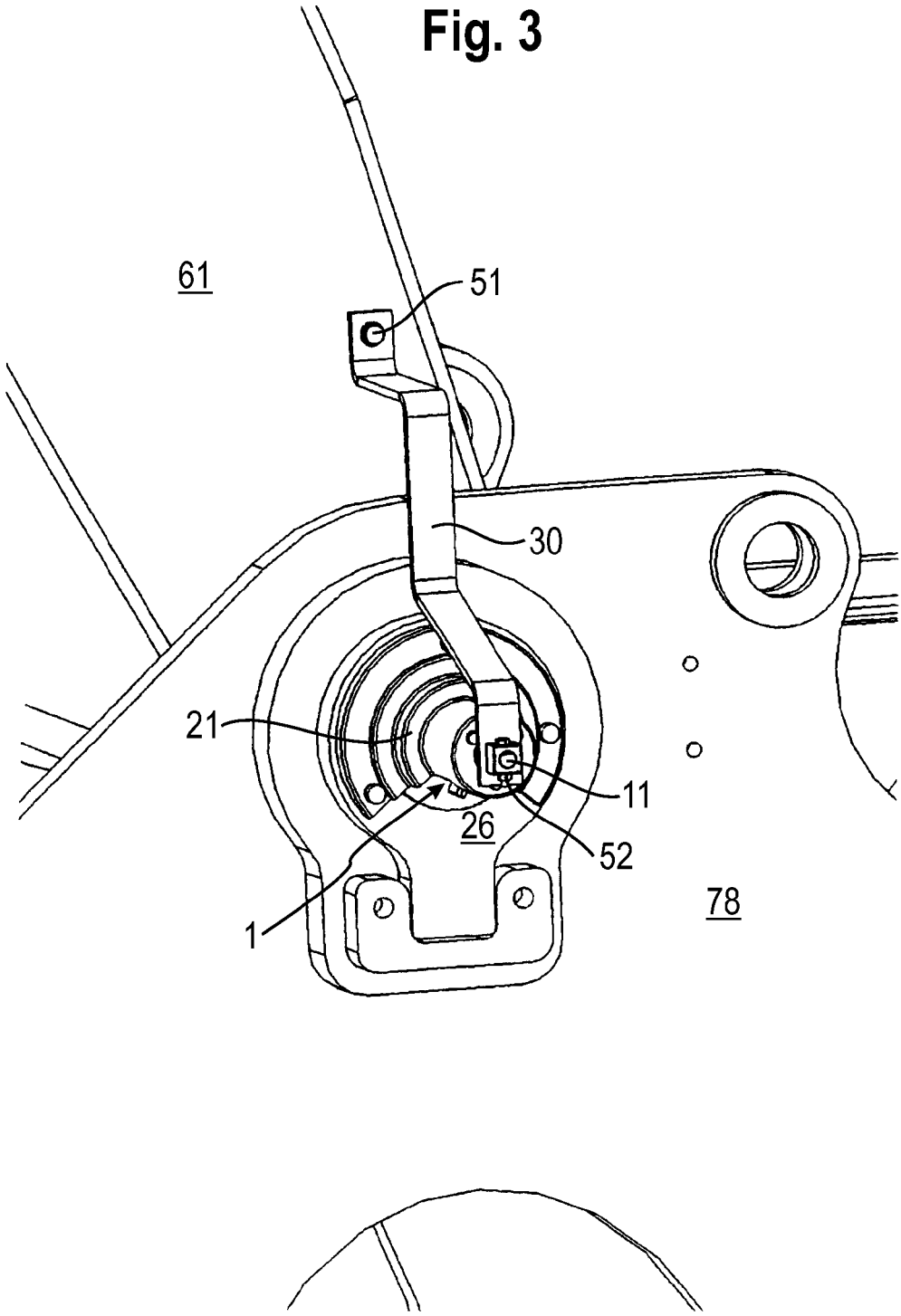
Figure 4:
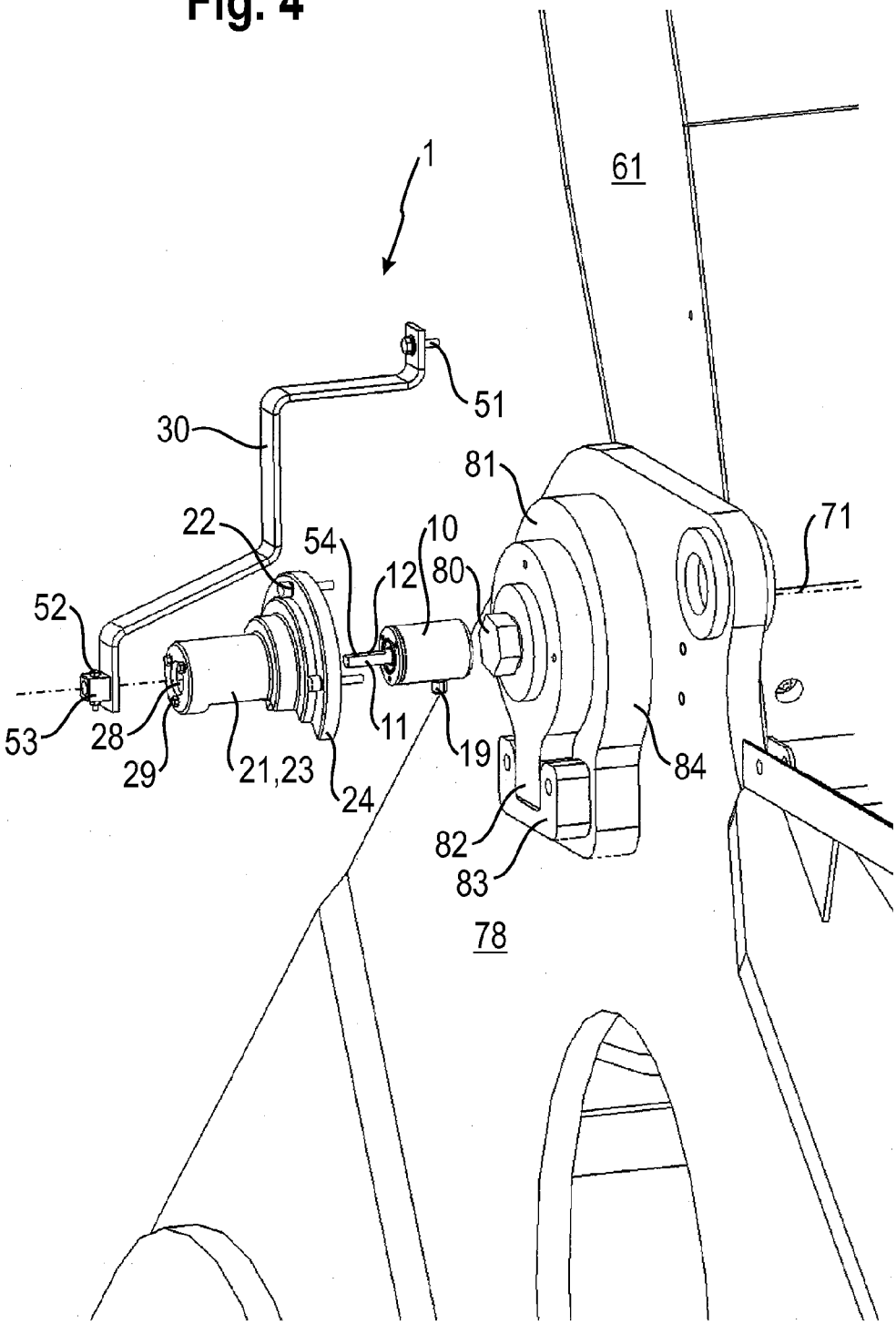

In the following the invention will be described in greater detail by way of preferred embodiments shown schematically in the accompanying Figures, wherein is shown:

FIG. 1 a side view of a construction apparatus according to the invention with rotary encoder;

FIG. 2 the center support of the chassis of the construction apparatus of FIG. 1 with a rotary encoder arranged thereon in an enlarged perspective view;

FIG. 3 an enlarged perspective view of the rotary encoder of FIG. 2; and FIG. 4 an exploded view of the rotary encoder of FIG. 2.

An embodiment of a construction apparatus in accordance with the invention, designed by way of example as a drilling apparatus, is shown in FIG. 1. The illustrated construction apparatus has a mast 4, on which a carriage 42 with a drill drive 41 is guided in a longitudinally displaceable manner. On the carriage 42 with the drill drive 41 a ground working apparatus 9 designed as a drill bit is in turn guided in a longitudinally displaceable manner. The mast 4 is supported by an adjustable support mechanism 6 which is arranged on a chassis 2 designed as a crawler-track running gear. The support mechanism 6 has a parallelogram kinematic mechanism with two parallel support arms 61 and 61. The support arm 61 is pivotably hinged about a horizontal pivot axis 71 on the chassis 2. By analogy, the second support arm 62 is pivotably hinged about a horizontally running second pivot axis 72 on the chassis 2. The two pivot axes 71 and 72 run parallel to each other, with the second pivot axis 72 being arranged below the pivot axis 71 and running closer to the mast.

On their respective sides facing away from the chassis 2 the two support arms 61 and 62 are hinged on a coupling element 64, on which the mast 4 is in turn provided in a pivotable manner. To pivot the mast 4 relative to the coupling element 64 a positioning drive designed as a neck-type cylinder 65 is provided.

For adjustment of the parallelogram kinematic mechanism with the two support arms 61, 62 a positioning drive 66 designed as a hydraulic cylinder is provided, which is hinged on the one hand on the chassis 2 and on the other hand on the coupling element 64. Through extension of this positioning drive 66 the support mechanism 6 can be moved from an approximately horizontal transport position into the vertical operating position depicted in FIG. 1.

As merely indicated in FIG. 1, in the area where the first support arm 61 is hinged on the chassis a rotary encoder 1 is provided, with which the pivot angle a of the support arm 61 relative to the chassis 2 can be detected. This pivot angle a (compare FIG. 2) represents a degree of the position of the support mechanism 6 and therefore a degree of the adjustment position of the mast 4.

FIG. 2 shows an enlarged cut-out view of the construction apparatus of FIG. 1 in the area of the rotary encoder 1. For the sake of clarity only a center support 70 of the chassis 2 is shown in FIG. 2, on which the first support arm 61 is hinged. The second support arm 62 is merely indicated.

On the center support 70 the chassis has two bearing plates 78, 78' which run parallel to each other and between which the two support arms 61 and 62 are hinged. These bearing plates 78 and 78' carry at least one axial bolt 75, which is merely indicated in FIG. 2 and on which the first support arm 61 is pivotably supported about the pivot axis 71, as well as at least one further parallel running axial bolt 76, on which the second support arm 62 is pivotably supported about the pivot axis 72.

As illustrated in FIG. 2, the rotary encoder 1 is arranged coaxially on the mathematical pivot axis 71 of the upper support arm 61 located further away from the mast, i.e. closer to the rear part. The rotary encoder 1 is situated on the exterior of the bearing plate 78 facing away from the support arm 61.

As indicated in FIGS. 1 and 2, provision is also made for a control unit 20 for controlling the positioning drive 66 and preferably also the neck-type cylinder 65. This control unit 20 is preferably in electric signal connection with the rotary encoder 1, allowing for the positioning drive 66, and if required also the neck-type cylinder 65, to be controlled depending on the pivot angle a detected by the rotary encoder 1 so that the mast 4 can be kept in a tilt-resistant adjustment range 6.

The detailed layout of the rotary encoder can be taken from FIGS. 3 and 4 in particular. As illustrated in these Figures, the rotary encoder 1 has an approximately cylindrical encoder housing 10, on the outer surface of which an electrical connection 19 for angular data signals is provided. At the front side of the encoder housing 10 an encoder shaft 11 protrudes from the former. The rotary encoder 1 is adapted such that the absolute rotation of the encoder shaft 11 relative to the encoder housing 10 is emitted as a signal.

The encoder shaft 11 and the cylindrical encoder housing 10 are arranged coaxially to the pivot axis 71 on the exterior of the bearing plate 78 for the support arm 61 so that the encoder shaft 11 protrudes perpendicularly from the bearing plate 78. To secure the encoder housing 10 in a rotationally fixed manner on the bearing plate 78, and therefore on the chassis 2, a cover 21 is provided. As shown in FIG. 4 in particular, the cover 21 has a cylindrical retaining section 23. In the cylindrical retaining section 23 the encoder housing 10 can be secured in a rotationally fixed manner by means of frontally arranged screws 29 on a vane 81 with radially protruding lug 82. The screws 29 surround a frontal through-hole 28 in the cover 21 that serves for the passage of the encoder shaft 11.

To define the position of the vane 81 the lug 82 engages in a U-shaped accommodation 83 arranged on a retaining plate 84, which is mounted on the bearing plate 78 in a defined position. A screw bolt 80 arranged concentrically to the pivot axis 71 penetrates the vane 81 and the retaining plate 82 and is in connection with the axial bolt 75.

On the side facing towards the bearing plate 78 the retaining section 23 of the cover 21 is followed coaxially by a flange section 24 with a larger external diameter. In this flange section 24 the cover 21 has holes 22 for establishing a bolt connection, more particularly a screw bolt connection, with the vane 81. These holes 22 are arranged with an asymmetrical hole pattern so that the position of the cover 21 relative to the chassis 2 is clearly defined. Similarly, an asymmetrical hole pattern can also be provided for the screws 29.

For the electrical connection of the rotary encoder 1 the cover 21, as depicted in FIG. 3 in particular, has a sector-shaped recess 26 which extends both across the retaining section 23 and the flange section 24 and permits access to connection 19.

The encoder shaft 11 is coupled in a rotationally fixed manner via an actuation bar 30 with the support arm 61. The actuation bar 30 is fastened at its one end by means of a screw bolt 51 on the support arm 61. At its other end the bar 30 is connected in a rotationally fixed manner by means of a screw bolt 52 to the encoder shaft 11. The bolt 52 runs transversely through a fastening sleeve 53 which is arranged on the bar 30 for mechanical reinforcement and serves for accommodating the encoder shaft 11. In the encoder shaft 11 a corresponding, transversely running hole 54 is provided, through which the bolt 52 is inserted for a rotationally fixed connection. For the purpose of easy positioning the otherwise cylindrical encoder shaft 11 has a flattening 12 in its outer surface, whereby a protrusion can be provided in the fastening sleeve 53 that corresponds with the flattening 12.

The actuation bar 30 is designed with a two-stepped profile which retraces the contour of the bearing plate 78 and the cover 21. The two-stepped profile is formed by a first step for adapting to the bearing plate 78, which has a rectangular design, and by a second step for adapting to the cover 21, which has an oblique-angled design.

The invention claimed is:

1. Construction apparatus for foundation construction, comprising:

a chassis, a mast adapted to guide at least one ground working apparatus, and a support mechanism for the mast, wherein the mast is arranged in an adjustable manner on the chassis, a positioning drive having a lower end and an upper end, the lower end is hingely connected to the chassis, the positioning drive is adapted to adjust the mast relative to the chassis, wherein the support mechanism has at least one support arm having a distal end pivotably hinged about a pivot axis on the chassis and another distal end coupled to the positioning drive and to the mast, the support mechanism has a further support arm which runs parallel to the first support arm, a rotary encoder disposed on the chassis and connected to the support arm to measure the pivot angle of the support arm relative to the chassis as a degree of an adjustment position of the mast, and a control unit adapted to control the positioning drive using the pivot angle measured by the rotary encoder and to counteract an excessive adjustment of the mast by the positioning drive.

2. Construction apparatus for foundation construction according to claim 1, wherein, with the positioning drive, controlled by the control unit, the support arm is pivotable about the pivot axis.

3. Construction apparatus for foundation construction according claim 1, wherein, while the one distal end the support arm is pivotably hinged about the pivot axis on the chassis, another distal end of the support arm is coupled with the mast.

4. Construction apparatus for foundation construction according to claim 1, wherein the further support arm runs parallel to the first support arm to form a parallelogram kinematic mechanism, and the first support arm, whose pivot angle is detected by the rotary encoder, is hinged above the further support arm on the chassis.

5. Construction apparatus for foundation construction according to claim 1, wherein the rotary encoder is arranged in the extension of the pivot axis.

6. Construction apparatus for foundation construction according to claim 1, wherein the rotary encoder has an encoder housing and an encoder shaft, wherein the encoder housing is coupled in a rotationally fixed manner with the chassis and the encoder shaft is coupled in a rotationally fixed manner with the support arm.

7. Construction apparatus for foundation construction according to claim 6, wherein, for a rotationally fixed connection with an actuation element, the encoder shaft of the rotary encoder has a flattening on its outer surface.

8. Construction apparatus for foundation construction according to claim 1, wherein a cover is provided for the rotary encoder, in which the rotary encoder is accommodated in a rotationally fixed manner.

9. Construction apparatus for foundation construction according to claim 8, wherein in the cover holes for a bolt connection with the chassis or the support arm are formed, in which case the holes have an asymmetrical hole pattern.

10. Construction apparatus for foundation construction according to claim 1, wherein, as actuation element for the rotary encoder, an actuation bar is provided, which is connected to the rotary encoder and to the support arm.

11. Construction apparatus for foundation construction according to claim 10, wherein the actuation bar has a multi-stepped profile.

12. Construction apparatus for foundation construction according to claim 1, wherein the rotary encoder is an absolute encoder.

13. Method for operating a construction apparatus for foundation construction according to claim 1, in which, in the case of certain pivot angles of the support arm relative to the chassis, an excessive adjustment of the mast by at least one positioning drive is counteracted by means of a control unit.

* * * * *